US009623276B1

(12) United States Patent
Deras

(10) Patent No.: US 9,623,276 B1
(45) Date of Patent: Apr. 18, 2017

(54) LIGHTWEIGHT EXERCISE BAR

(71) Applicant: Jose Deras, Coral Gables, FL (US)

(72) Inventor: Jose Deras, Coral Gables, FL (US)

( * ) Notice: Subject to any disclaimer, the term of this patent is extended or adjusted under 35 U.S.C. 154(b) by 0 days.

(21) Appl. No.: 14/854,122

(22) Filed: Sep. 15, 2015

(51) Int. Cl.
*A63B 21/00* (2006.01)
*A63B 21/072* (2006.01)
*A63B 23/12* (2006.01)

(52) U.S. Cl.
CPC ..... *A63B 21/4035* (2015.10); *A63B 21/0724* (2013.01); *A63B 23/12* (2013.01)

(58) Field of Classification Search
CPC ..... A63B 21/00
USPC ..... 482/106, 108, 109
See application file for complete search history.

(56) References Cited

U.S. PATENT DOCUMENTS

| | | | | |
|---|---|---|---|---|
| 2,470,815 | A * | 5/1949 | Harvey | A63B 21/0724 482/104 |
| 5,839,996 | A | 11/1998 | Gooding | |
| D556,841 | S | 12/2007 | Oates | |
| D633,155 | S | 2/2011 | Brun | |
| 8,092,353 | B2 | 1/2012 | Yang | |
| 2009/0093349 | A1 | 4/2009 | Cooper | |
| 2013/0296145 | A1 | 11/2013 | Tomaszewski | |
| 2014/0121074 | A1 | 5/2014 | Cohocaru | |
| 2014/0336019 | A1 | 11/2014 | Villella | |

FOREIGN PATENT DOCUMENTS

CA 2851840 A1 5/2014

* cited by examiner

*Primary Examiner* — Jerome W Donnelly

(57) ABSTRACT

The light weight exercise bar is a weight bar that is built to simulate an Olympic style bar but that is much lighter in weight. This reduction in weight allows new lifters to safely learn and practice difficult Olympic style exercises such snatch and the clean and jerk. The light weigh exercise bar comprises a men's weight bar and a women's weight bar.

9 Claims, 4 Drawing Sheets

LIGHTWEIGHT EXERCISE BAR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of educational devices related to physical education, more specifically, a weight bar adapted for use in weight training.

The standard men's Olympic weight bar is 2.2 meters and weighs 20 kg. The bar has a 50 mm diameter at each end and tapers down to 28 mm at the grip. The standard women's Olympic weight bar is 2.01 meters and weighs 15 kg. The bar has a 50 mm diameter at each end and tapers down to 24 mm at the grip.

With the increasing popularity of weight training in cross-training programs, there in interest in performing relatively difficult weight training movements such as the Olympic style snatch and the Olympic style clean and jerk. This increase of relatively inexperienced people performing these difficult exercises increases the risk of injury. To reduce this risk, a tool is needed to allow people to learn and practice Olympic style snatch and the Olympic style clean and jerk with a lower risk of injury.

SUMMARY OF INVENTION

The current disclosure addresses the above shortcomings of weight training.

The light weight exercise bar is a weight bar that is built to simulate an Olympic style bar but that is much lighter in weight. This reduction in weight allows new lifters to safely learn and practice difficult Olympic style exercises such snatch and the clean and jerk.

These together with additional objects, features and advantages of the light weight exercise bar will be readily apparent to those of ordinary skill in the art upon reading the following detailed description of the presently preferred, but nonetheless illustrative, embodiments when taken in conjunction with the accompanying drawings.

In this respect, before explaining the current embodiments of the light weight exercise bar in detail, it is to be understood that the light weight exercise bar is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the light weight exercise bar.

It is therefore important that the claims be regarded as including such equivalent construction insofar as they do not depart from the spirit and scope of the light weight exercise bar. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figures 1, 2:
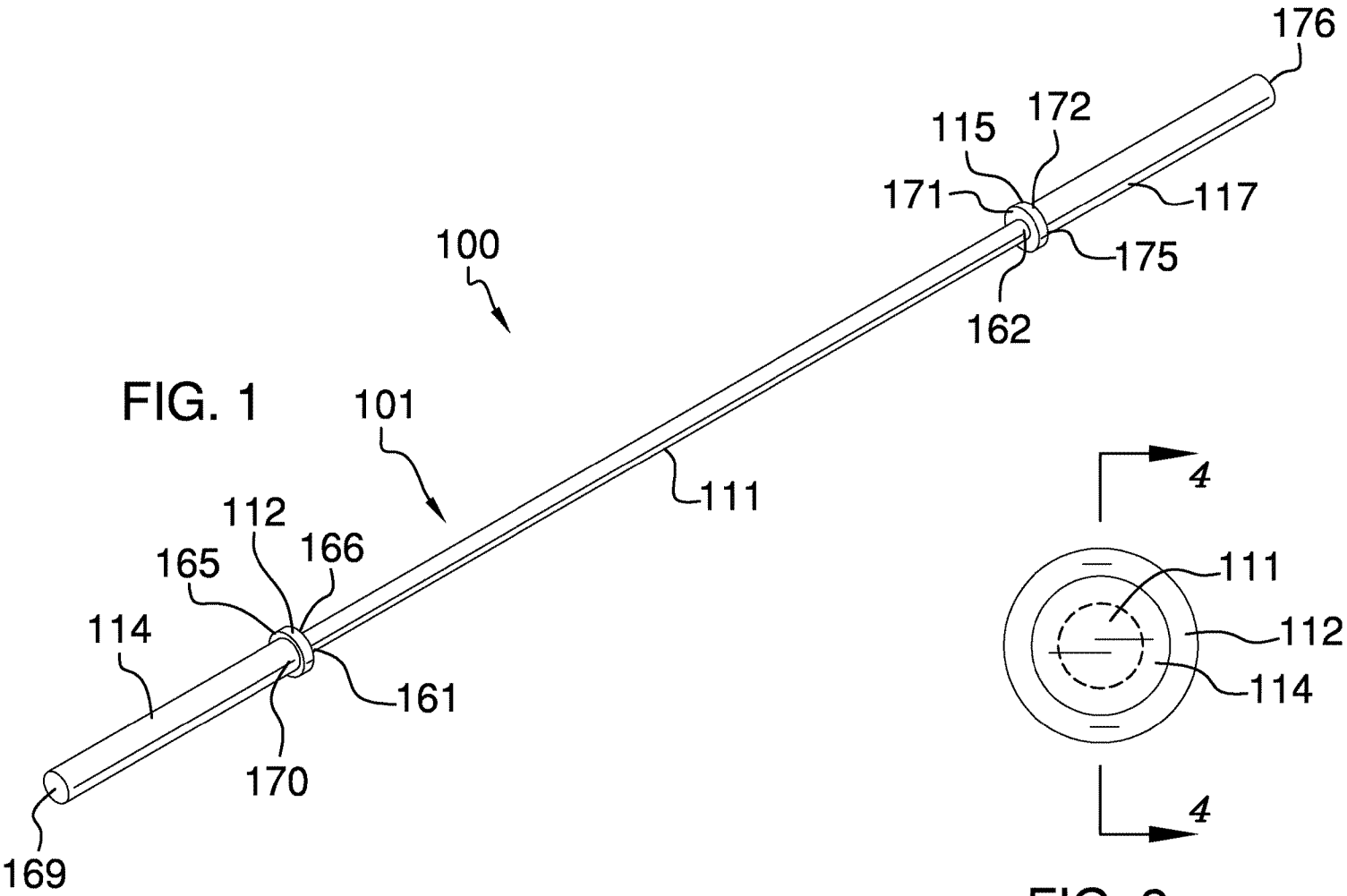
FIG. 1 is a perspective view of an embodiment of the disclosure.
FIG. 2 is a side view of an embodiment of the disclosure.
Figure 3:
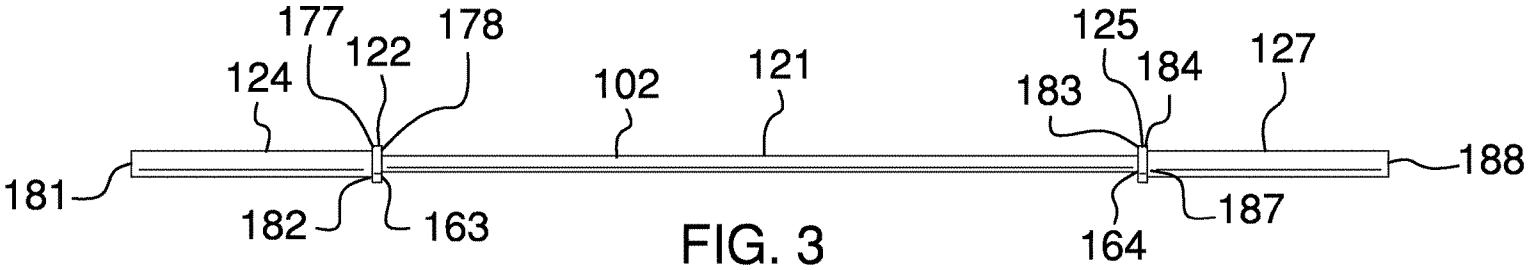
FIG. 3 is a front view of an embodiment of the disclosure.
Figure 4:
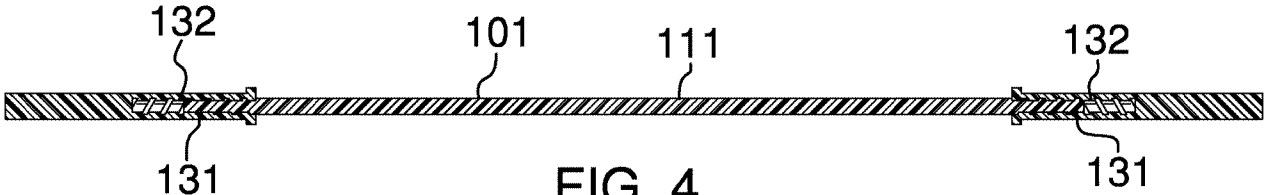
FIG. 4 is a cross-sectional view of an embodiment of the disclosure across 4-4.
Figure 5:
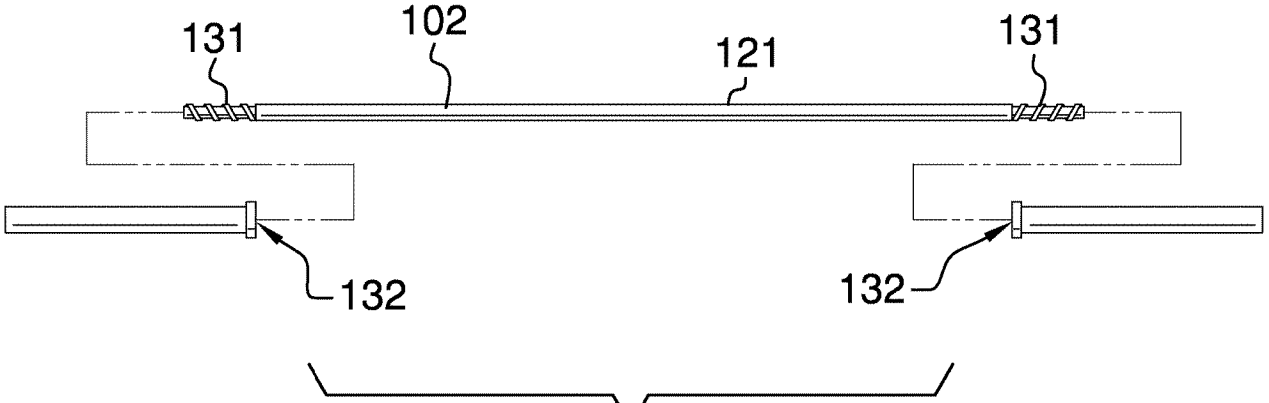
FIG. 5 is an exploded view of an embodiment of the disclosure.
Figure 6:
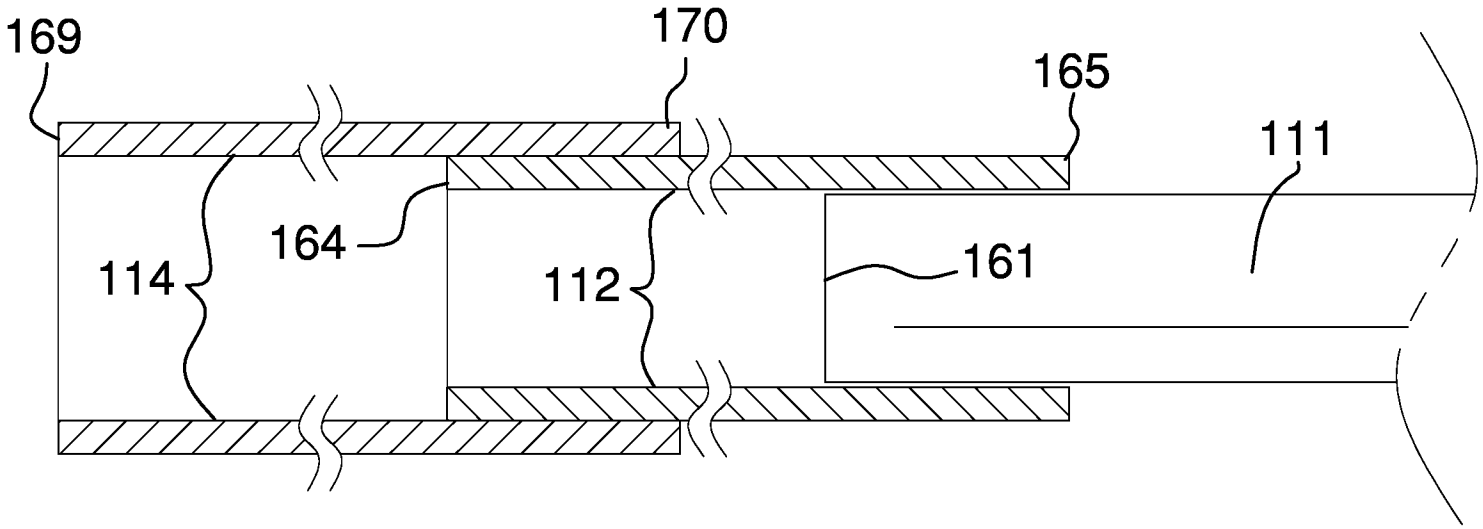
FIG. 6 is a detail view of an embodiment of the disclosure
Figure 7:
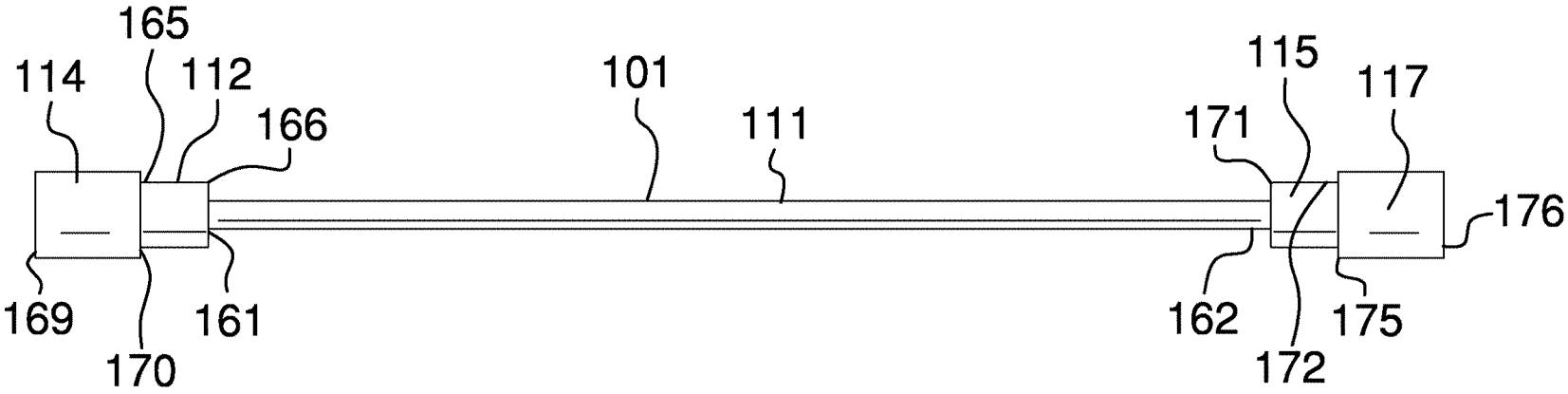
FIG. 7 is an alternate view of an embodiment of the disclosure.

Detailed reference will now be made to a first potential embodiment of the disclosure, which is illustrated in FIGS. 1 through 7. The light weigh exercise bar 100 (hereinafter invention) comprises a men's weight bar and a women's weight bar.

The men's weight bar 101 further comprises a men's aluminum bar 111, a first PVC pipe 112, a third PVC pipe 114, a fourth PVC pipe 115, and a sixth PVC pipe 117. The men's aluminum bar 111 is further defined with a first end 161 and a second end 162. The first PVC pipe 112 is further defined with a fifth end 165 and a sixth end 166. The third PVC pipe 114 is further defined with a ninth end 169 and a tenth end 170. The fourth PVC pipe 115 is further defined with an eleventh end 171 and a twelfth end 172. The sixth PVC pipe 117 is further defined with a fifteenth end 175 and a sixteenth end 176.

The men's aluminum bar 111 is a commercially available solid aluminum bar. The men's aluminum bar is 180 cm in length and has a nominal weight of approximately 2575 grams. The first pvc pipe 112 and the fourth pvc pipe 115 are commercially available schedule 40 pvc pipe with a 1.315 inch outer diameter and a 1.029 inch inner diameter. The first pvc pipe 112 and the fourth pvc pipe 115 are both cut to 16 cm in length and both have a nominal weight of approximately 293 grams. The third pvc pipe 114 and the sixth pvc pipe 117 are commercially available schedule 40 pvc pipe with a 1.90 inch outer diameter and a 1.59 inch inner diameter. The third pvc pipe 114 and the sixth pvc pipe 117 are both cut to 8 cm in length and both have a nominal weight of approximately 237 grams.

The men's weight bar 101 is assembled as follows: The tenth end 170 of the third PVC pipe 114 is slid 2 cm over the fifth end 164 of the first PVC pipe 112 and is glued into position. The fifteenth end 117 of the sixth pipe 117 is slid 2 cm over the twelfth end 172 of the fourth pipe 115 and glued into position. The sixth end 166 of the first PVC pipe 112 can be attached to the first end 161 of the men's aluminum bar 111 in two ways. In the first way, the sixth end 166 is slid 2 cm over the first end 161 and glued into position. In the second way, the sixth end 166 is fitted with an 2 cm deep interior screw thread 132 and the first end 161 is fitted with an 2 cm long exterior screw thread 131 and the sixth end 166 is screwed on to the first end 161. The eleventh end 171 of the fourth PVC pipe 115 can be attached to the second end 162 of the men's aluminum bar 111 in two ways. In the first way, the eleventh end 171 is slid 2 cm over the second end 162 and glued into position. In the second way, the eleventh end 171 is fitted with a 2 cm deep interior screw thread 132 and the second end 162 is fitted with a 2 cm long exterior screw thread 131 and the eleventh end 171 is screwed on to the second end 162.

The end result is that the men's weight bar 101 is 220 cm long but weighs approximately 8.1 pounds The women's weight bar further comprises a women's aluminum bar 121, a seventh PVC pipe 122, a ninth PVC pipe 124, a tenth PVC pipe 125, and a twelfth PVC pipe 127. The women's aluminum bar 121 is further defined with a third end 163 and a fourth end 164. The seventh PVC pipe 122 is further defined with a seventeenth end 177 and an eighteenth end 178. The ninth PVC pipe 124 is further defined with a twenty first end 181 and a twenty second end 182. The tenth PVC pipe 125 is further defined with a twenty third end 183 and a twenty fourth end 184. The twelfth PVC pipe 127 is further defined with a twenty seventh end 187 and a twenty eight end 188.

The women's aluminum bar 121 is a commercially available solid aluminum bar. The women's aluminum bar is 161 cm in length and has a nominal weight of approximately 2305 grams. The seventh pvc pipe 122 and the tenth pvc pipe 125 are commercially available schedule 40 pvc pipe with a 1.315 inch outer diameter and a 1.029 inch inner diameter. The seventh pvc pipe 122 and the tenth pvc pipe 125 are both cut to 16 cm in length and both have a nominal weight of approximately 293 grams. The ninth pvc pipe 124 and the twelfth pvc pipe 127 are commercially available schedule 40 pvc pipe with a 1.90 inch outer diameter and a 1.59 inch inner diameter. The ninth pvc pipe 124 and the twelfth pvc pipe 127 are both cut to 8 cm in length and both have a nominal weight of approximately 237 grams.

The women's weight bar 102 is assembled as follows: The twenty second end 182 of the ninth PVC pipe 124 is slid 2 cm over the seventeenth end 177 of the seventh PVC pipe 122 and is glued into position. The twenty seventh end 187 of the twelfth pipe 127 is slid 2 cm over the twenty fourth end 184 of the tenth pipe 125 and glued into position. The eighteenth end 168 of the seventh PVC pipe 122 can be attached to the third end 163 of the women's aluminum bar 121 in two ways. In the first way, the eighteenth end 168 is slid 2 cm over the third end 163 and glued into position. In the second way, the eighteenth end 168 is fitted with an 2 cm deep interior screw thread 132 and the third end 163 is fitted with an 2 cm long exterior screw thread 131 and the eighteenth end 168 is screwed on to the third end 163. The twenty third end 183 of the tenth PVC pipe 125 can be attached to the fourth end 164 of the women's aluminum bar 121 in two ways. In the first way, the twenty third end 183 is slid 2 cm over the fourth end 164 and glued into position. In the second way, the twenty third end 183 is fitted with a 2 cm deep interior screw thread 132 and the fourth end 164 is fitted with a 2 cm long exterior screw thread 131 and the twenty third end 183 is screwed on to the fourth end 164.

The end result is that the men's weight bar 101 is 201 cm long but weighs approximately 7.4 pounds The men's weight bar 101 and the women's weight bar 102 can be used as normal weight bars except that the men's weight bar 101 and the women's weight bar 102 cannot be used to support weight plates.

Aluminum bars, epoxy resin glue, and PVC piping are commercially available.

The following definitions were used in this disclosure:

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the inner diameter of a pipe.

PVC: As used in this disclosure, pvc is an acronym for polyvinylchloride.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A plurality of weight bars comprising:

a men's weight bar and a women's weight bar;

wherein the men's weight bar simulates a men's Olympic weight bar;

wherein the women's weight bar simulates a women's Olympic weight bar;

wherein the men's weight bar weighs less than 9 pounds;

wherein the women's weight bar weighs less than 9 pounds;

wherein the men's weight bar is a training device that is used to practice the Olympic style clean and jerk exercise;

wherein the women's weight bar is a training device that is used to practice the Olympic style clean and jerk exercise;

wherein the men's weight bar is a training device that is used to practice Olympic style snatch exercise;

wherein the women's weight bar is a training device that is used to practice Olympic style snatch exercise;

wherein the men's weight bar further comprises a men's aluminum bar, a first PVC pipe, a second PVC pipe, a third PVC pipe, and a fourth PVC pipe;

the men's aluminum bar is further defined with a first end and a second end;

wherein the first PVC pipe is further defined with a third end and a fourth end;

wherein the second PVC pipe is further defined with a fifth end and a sixth end;

wherein the third PVC pipe is further defined with an seventh end and a eighth end;

wherein the fourth PVC pipe is further defined with a ninth end and a tenth end;

wherein the men's aluminum bar is a commercially available solid aluminum bar;

wherein the men's aluminum bar is 180 cm in length.

2. The plurality of weight bars according to claim 1 wherein the first pvc pipe and the third PVC pipe are both cut to 16 cm in length.

3. The plurality of weight bars according to claim 2 wherein the second PVC pipe and the fourth PVC pipe are both cut to 8 cm.

4. The plurality of weight bars according to claim 3 wherein the sixth end of the second PVC pipe is slid 2 cm over the third end of the first PVC pipe and glued into position;

wherein the ninth end of the sixth pipe is slid 2 cm over the eighth end of the fourth pipe and glued into position.

5. The plurality of weight bars according to claim 4 wherein the fourth end is slid 2 cm over the first end and glued into position;

wherein the seventh end is slid 2 cm over the second end and glued into position.

6. The plurality of weight bars according to claim 4 wherein the fourth end is fitted with an 2 cm deep interior screw thread;

wherein the first end is fitted with an 2 cm long exterior screw thread;

wherein the fourth end is screwed on to the first end;

wherein the seventh end is fitted with a 2 cm deep interior screw thread;

wherein the second end is fitted with a 2 cm long exterior screw thread;

wherein and the seventh end is screwed on to the second end.

7. A plurality of weight bars comprising:

a men's weight bar and a women's weight bar;

wherein the men's weight bar simulates a men's Olympic weight bar;

wherein the women's weight bar simulates a women's Olympic weight bar;

wherein the men's weight bar weighs less than 9 pounds;

wherein the women's weight bar weighs less than 9 pounds;

wherein the men's weight bar is a training device that is used to practice the Olympic style clean and jerk exercise;

wherein the women's weight bar is a training device that is used to practice the Olympic style clean and jerk exercise;

wherein the men's weight bar is a training device that is used to practice Olympic style snatch exercise;

wherein the women's weight bar is a training device that is used to practice Olympic style snatch exercise;

the men's weight bar further comprises a men's aluminum bar, a first PVC pipe, a second PVC pipe, a third PVC pipe, and a fourth PVC pipe;

the men's aluminum bar is further defined with a first end and a second end;

wherein the first PVC pipe is further defined with a third end and a fourth end;

wherein the second PVC pipe is further defined with a fifth end and a sixth end;

wherein the third PVC pipe is further defined with an seventh end and a eighth end;

wherein the fourth PVC pipe is further defined with a ninth end and a tenth end;

wherein the men's aluminum bar is a commercially available solid aluminum bar;

wherein the men's aluminum bar is 161 cm in length;

wherein the first pvc pipe and the third PVC pipe are both cut to 16 cm in length;

wherein the second PVC pipe and the fourth PVC pipe are both cut to 8 cm;

wherein the sixth end of the second PVC pipe is slid 2 cm over the third end of the first PVC pipe and glued into position;

wherein the ninth end of the sixth pipe is slid 2 cm over the eighth end of the fourth pipe and glued into position.

8. The plurality of weight bars according to claim 7 wherein the fourth end is slid 2 cm over the first end and glued into position;

wherein the seventh end is slid 2 cm over the second end and glued into position.

9. The plurality of weight bars according to claim 7 wherein the fourth end is fitted with an 2 cm deep interior screw thread;

wherein the first end is fitted with an 2 cm long exterior screw thread;

wherein the fourth end is screwed on to the first end;

wherein the seventh end is fitted with a 2 cm deep interior screw thread;

wherein the second end is fitted with a 2 cm long exterior screw thread;

wherein and the seventh end is screwed on to the second end.

* * * * *